US005162009A

United States Patent [19]

Vaughn

[11] Patent Number: 5,162,009

[45] Date of Patent: Nov. 10, 1992

[54] TOY RACE TRACK APPARATUS

[76] Inventor: Hurley G. Vaughn, Rte. 1, Box 301, Ennice, N.C. 28623

[21] Appl. No.: 780,964

[22] Filed: Oct. 23, 1991

[51] Int. Cl.[5] ..... A63H 11/02; A63H 18/00; A63F 9/14; A63F 3/00

[52] U.S. Cl. ..... 446/3; 446/449; 273/86 E; 273/238

[58] Field of Search ..... 273/86 E, 86 D, 237, 273/238, 247, 277; 446/3, 444, 445

[56] References Cited

U.S. PATENT DOCUMENTS

| | | | |
|---|---|---|---|
| 2,167,068 | 7/1939 | Gueydan | 273/86 E X |
| 2,167,985 | 8/1939 | Levay | 273/86 E |
| 2,551,806 | 5/1951 | McKeever | 273/86 B |
| 3,011,787 | 12/1961 | Medica, Jr. et al. | 446/3 X |
| 3,266,802 | 8/1966 | Balanyi | 273/86 B |
| 3,315,632 | 4/1967 | Hyden | 273/86 B X |
| 3,496,674 | 2/1970 | Cooper | 273/86 B X |
| 3,588,107 | 6/1971 | Kupperman et al. | 273/86 E |
| 3,841,636 | 10/1974 | Meyer | 446/3 X |
| 4,147,351 | 4/1979 | Saito | 273/86 B |

FOREIGN PATENT DOCUMENTS

| | | | |
|---|---|---|---|
| 1145460 | 10/1957 | France | 446/3 |
| 454989 | 6/1950 | Italy | 446/457 |
| 268878 | 9/1950 | Switzerland | 446/3 |
| 645147 | 10/1950 | United Kingdom | 128/36 |

*Primary Examiner*—David N. Muir
*Attorney, Agent, or Firm*—Leon Gilden

[57] ABSTRACT

A race track includes a recessed continuous track path directed through a top surface of a rigid game board, wherein the rigid game board includes a vibratory mechanism to transmit vibratory energy to tokens mounted within the race track path. The race track tokens include a plurality of vibratory transmitting tabs projecting downwardly through a bottom surface of each token, wherein the tabs may optionally be rotatably mounted upon a rotary cylinder to permit directional orientation to each token during its traverse of the path.

1 Claim, 5 Drawing Sheets

TOY RACE TRACK APPARATUS

BACKGROUND OF THE INVENTION

1. Field of the Invention

The field of invention relates to race track apparatus, and more particularly pertains to a new and improved toy race track apparatus wherein the same is arranged to direct tokens about a continuous recessed path.

2. Description of the Prior Art

Vibratory games of various types have been utilized in the prior art to direct play about a game path. Such a game is exemplified in U.S. Pat. No. 3,940,140 to Meyer, et al. wherein a continuous path houses vehicle tokens utilizing rearwardly directed tabs for imparting motion to the tokens.

U.S. Pat. No. 3,769,743 to Benkoe, et al. sets forth a vibratory toy utilizing vibration to direct and impart orientation to various tokens.

U.S. Pat. No. 3,548,534 to Beny, et al. sets forth a vehicle toy utilizing a continuous conveyor to direct vehicles upon the path of the race track structure.

As such, it may be appreciated that there continuous to be a need for a new and improved toy race track game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of game apparatus now present in the prior art, the present invention provides a toy race track apparatus wherein the same is arranged to convert vibratory energy into directional motion about a game path of a game board. As such, the general purpose of the present invention, which will be described subsequently in greater detail, is to provide a new and improved toy race track apparatus which has all the advantages of the prior art game apparatus and none of the disadvantages.

To attain this, the present invention provides a race tracking including a recessed continuous track path directed through a top surface of a rigid game board, wherein the rigid game board includes a vibratory mechanism to transmit vibratory energy to tokens mounted within the race track path. The race track tokens include a plurality of vibratory transmitting tabs projecting downwardly through a bottom surface of each token, wherein the tabs may optionally be rotatably mounted upon a rotary cylinder to permit directional orientation to each token during its travers of the path.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy race track apparatus which has all the advantages of the prior art game apparatus and none of the disadvantages.

It is another object of the present invention to provide a new and improved toy race track apparatus which may be easily and efficiently manufactured and marketed.

It is a further object of the present invention to provide a new and improved toy race track apparatus which is of a durable and reliable construction.

An even further object of the present invention is to provide a new and improved toy race track apparatus which is susceptible of a low cost of manufacture with regard to both materials and labor, and which accordingly is then susceptible of low prices of sale to the consuming public, thereby making such toy race track apparatus economically available to the buying public.

Still yet another object of the present invention is to provide a new and improved toy race track apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
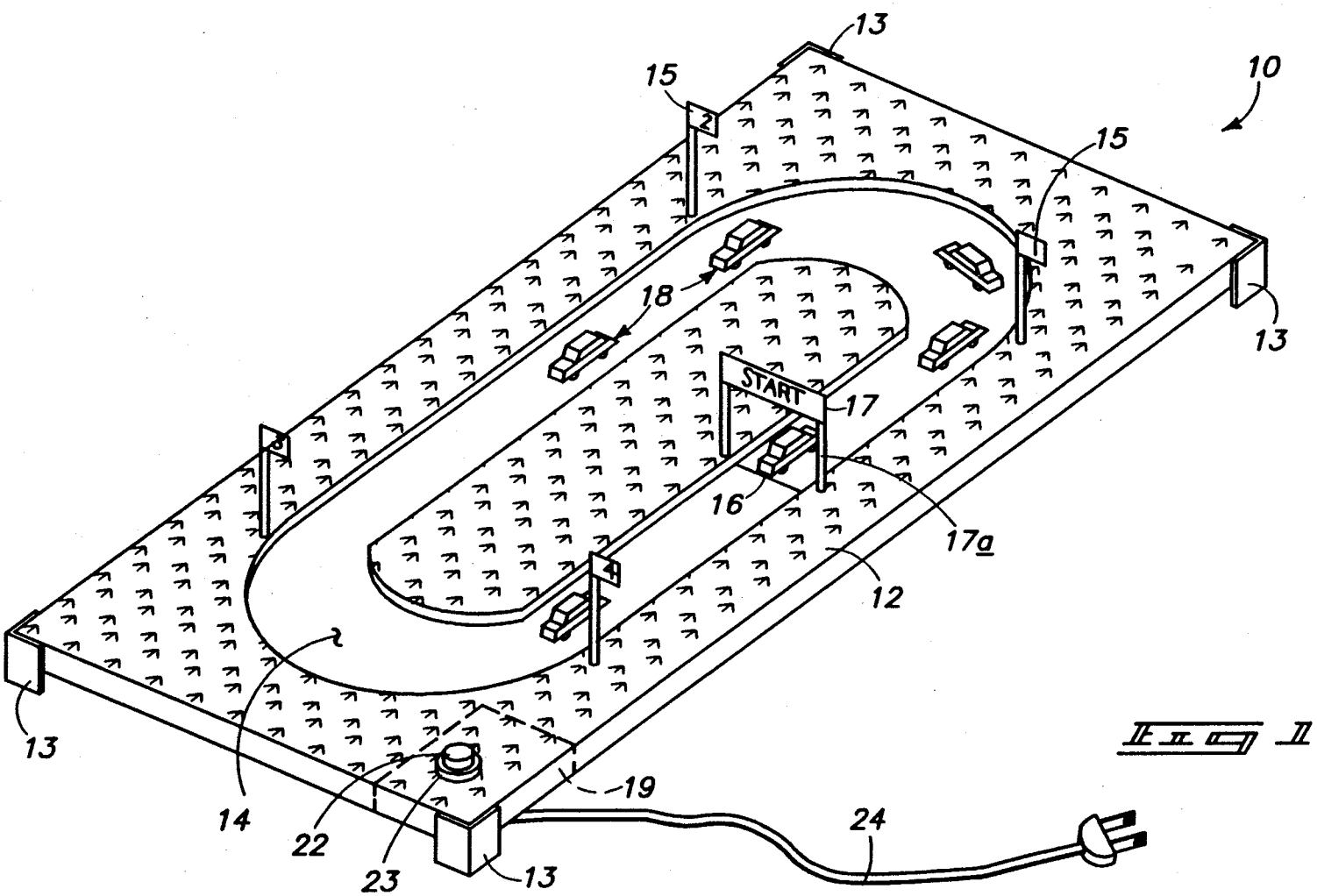
FIG. 1 is an isometric illustration of the instant invention.
Figure 2:
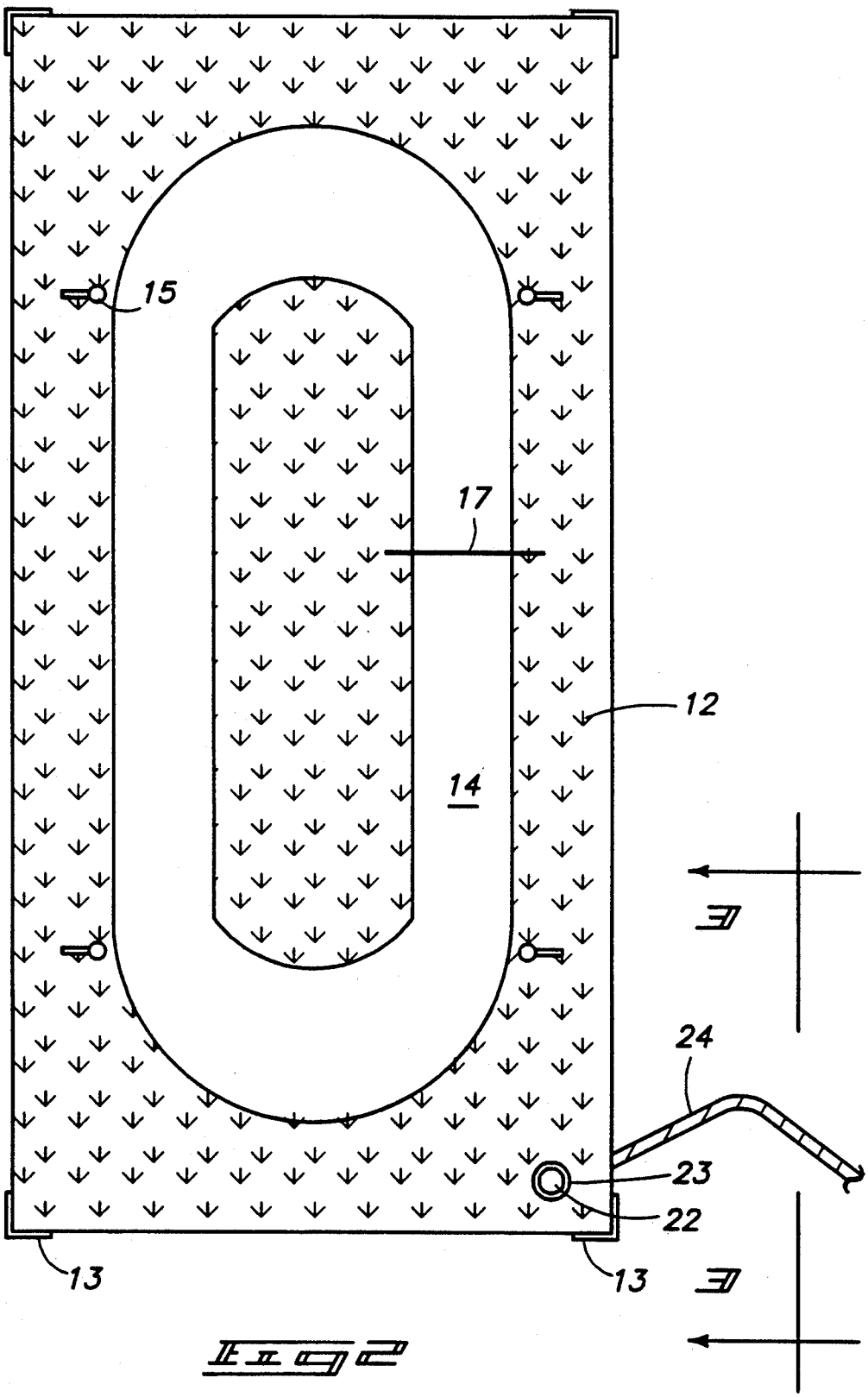
FIG. 2 is an orthographic top view of the instant invention.
Figure 3:
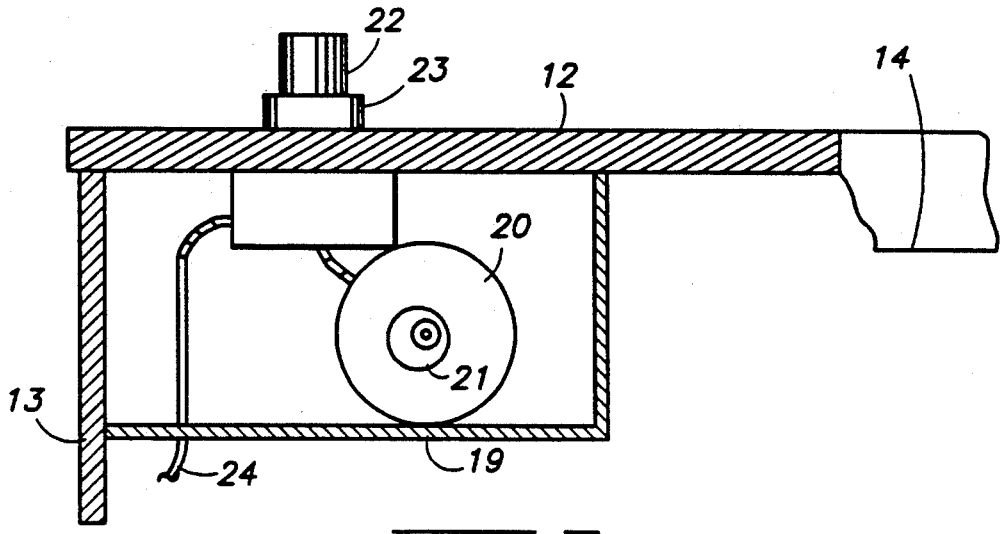
FIG. 3 is an orthographic view, taken along the lines 3—3 of FIG. 2 in the direction indicated by the arrows, partially in section.
Figure 4:
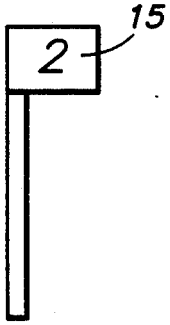
FIG. 4, FIG. 5, FIG. 6, and FIG. 7 illustrate the various marker flags utilized by the apparatus.
Figure 5:
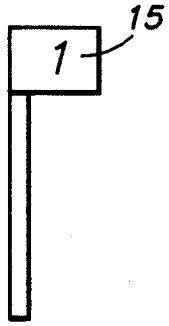
Figure 8:
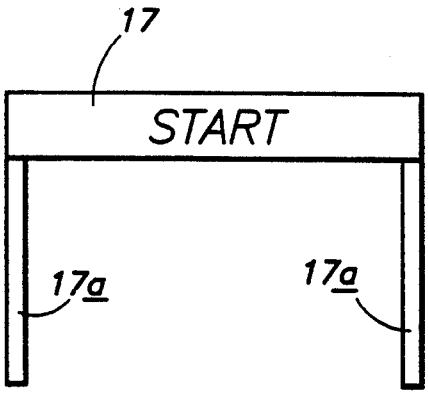
FIG. 8 is an orthographic view of the start placard utilized by the invention.
Figure 6:
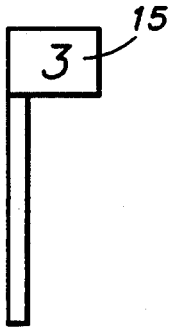
Figure 7:
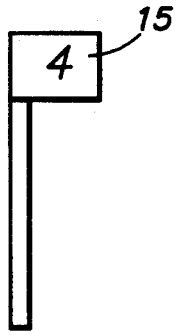
Figure 9:
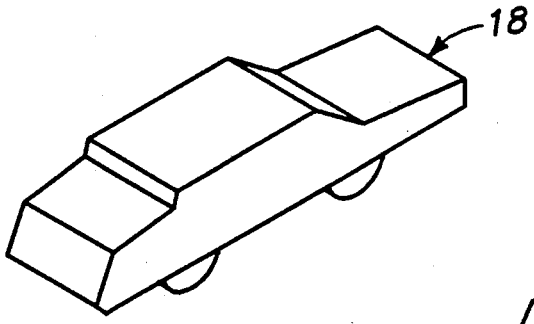
FIG. 9 is an isometric illustration of a race track token utilized by the invention.
Figure 10:
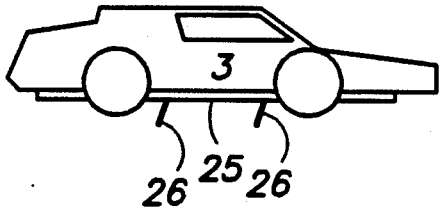
FIG. 10 is an orthographic side view of the token, as illustrated in FIG. 9.
Figure 11:
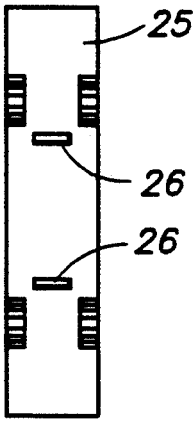
FIG. 11 is an orthographic bottom view of the token structure, as illustrated in FIGS. 9 and 10.
Figure 12:
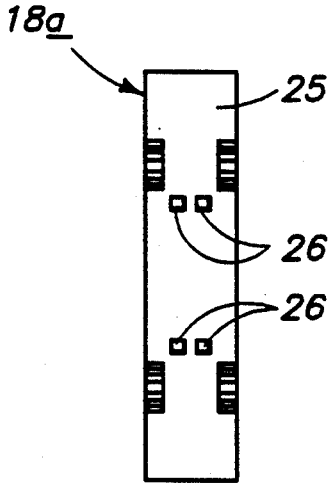
FIG. 12 is an orthographic modified illustration of the token utilized by the invention.

With reference now to the drawings, and in particular to FIGS. 1 to 16 thereof, a new and improved toy race track apparatus embodying the principles and concepts of the present invention and generally designated by the reference numeral 10 will be described.

More specifically, the toy race track apparatus 10 of the instant invention essentially comprises a rigid game board 12 defined by a planar top surface, with a plurality of support legs 13 directed orthogonally and downwardly relative to the top surface for support thereof. A continuous race track path recess 14 is directed into the planar top surface of the game board 12 extending downwardly thereof to define a continuous path for traverse of the plurality of race car tokens 18 positioned thereon. A plurality of track position flags 15 are positioned at spaced intervals along an exterior perimeter of the path 14 to permit demarcating of the path for various time trials and the like to permit an individual to gauge various times between various flags as required. A starting line 16 orthogonally directed across the path 14 includes a starting line placard 17 spaced above and parallel to the path 14 mounted upon a plurality of posts 17*a* positioned to an inside and outside portion of the path extending orthogonally upwardly relative to the game board top surface.

A vibratory housing 19 is mounted to the game board 12 relative to the planar top surface, wherein the vibratory housing 19 is rigid and mounts a vibratory motor 20 therewithin. An eccentric weight 21 mounted coaxially to the motor imparts vibration through the vibration housing 19 into the game board, and particularly into the path 14. An on/off switch 22 effects actuation of the motor 20, with a rheostat dial 23 mounted in electrical communication with the motor 20 to effect modulation of the rate of vibration directed into the planar top surface by effecting the RPM rate of the motor 20. An electrical power supply cord 24 directs electrical energy into the motor through the switch structure and rheostat dial 23.

Each of the race track tokens 18 includes a token planar bottom surface 25, with a forward and rear semi-rigid polymeric vibration transfer tab 26 canted rearwardly relative to a forward end of each token to impart directional orientation forwardly to each of the tokens 18 when positioned upon the vibrating path 14. A modified token 18*a*, as illustrated in the FIG. 12, utilizes a pair of the tabs 26 positioned in a forward and rear orientation, wherein the tabs are in a parallel relationship relative to one another.

Figure 13:
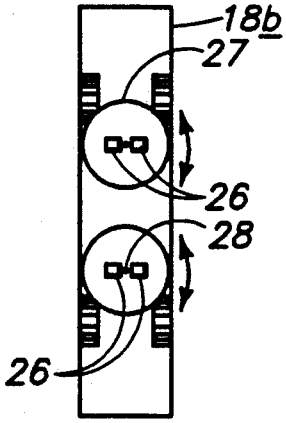
FIG. 13 is an orthographic bottom view of a token in utilization of a modified directing apparatus mounted to the bottom surface thereof.
Figure 14:
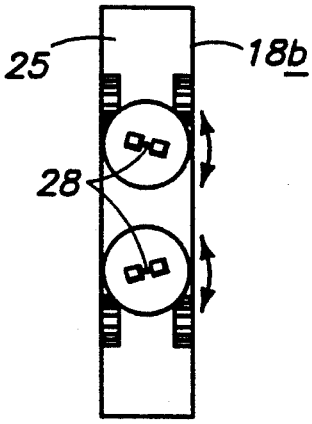
FIG. 14 is an orthographic bottom view of the modified token with the directing structure oriented in a further orientation relative to the bottom surface of the token.

The FIGS. 13 and 14 illustrate a further modified token 18*b*, wherein a pair of the tabs 26 are mounted to a forward and rear turn table cylinder 27. The turn table cylinders 27 are each rotatably mounted about a respective cylinder axle 28. In this manner, directional orientation to each of the tokens is available to accommodate various traffic upon the path 14 as well as to accommodate the curvilinear turns in a more desirable manner in use of the game board.

Figure 15:
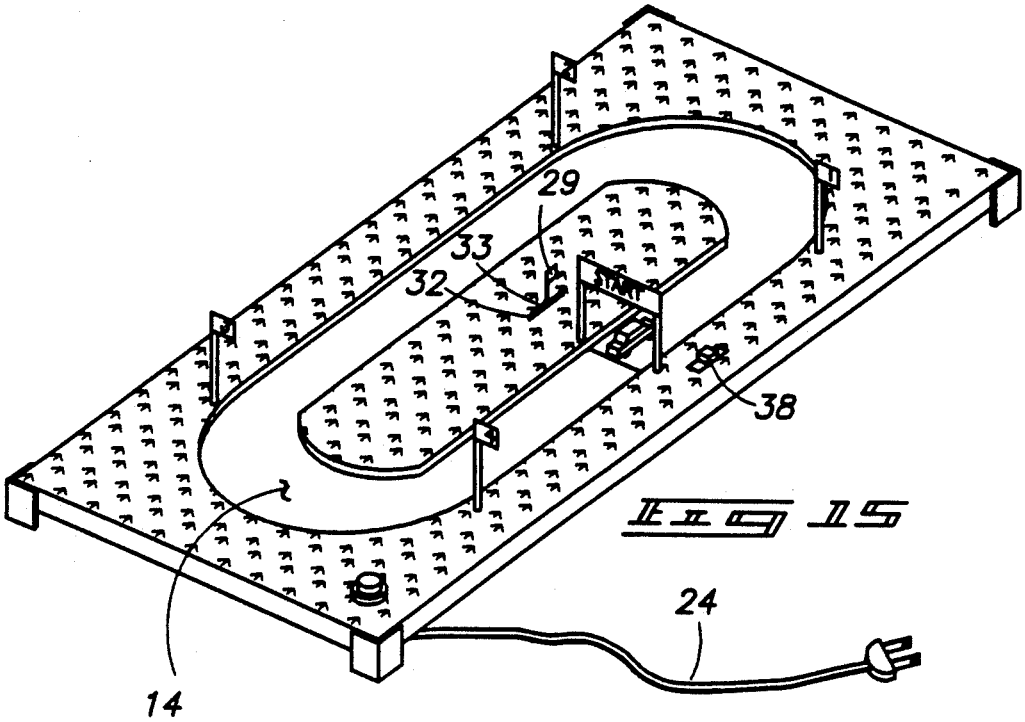
FIG. 15 is an isometric illustration of a modified game board structure.
Figure 16:
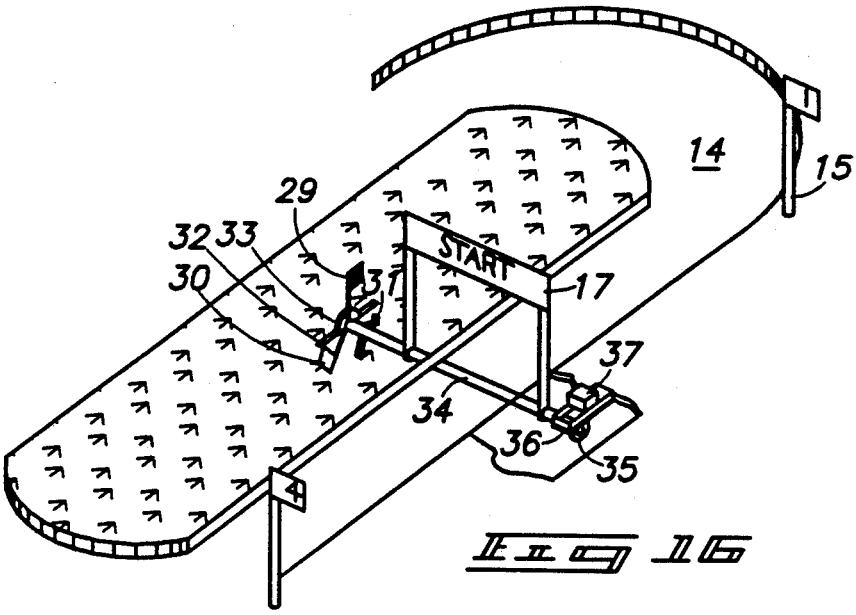
FIG. 16 is an isometric view, partially in section, of the modified game board structure.

The FIGS. 15 and 16 illustrate the use of an indicator flag arrangement to include a respective first, second, and third flag 29, 30, and 31. The first flag 29 is defined as a checkered flag to indicate culmination of a racing event, the second flag 30 is defined as a green flag to signal commencement of a race, and the third flag 31 is a yellow or caution flag utilized in the game to indicate various tie-ups and the like within the path to permit the players to separate the tokens to continue the race. The flags 29, 30, and 31 are arranged in a parallel relationship relative to one another and are directed radially and outwardly of a flag cylindrical hub support 33. The hub support 33 is coaxially mounted to a hub axle 34 positioned below the top surface of the game board 12. In this manner, the flags 29, 30, and 31 are sequentially positioned as desired through a first slot 32 directed through the game board 12 and arranged in an orthogonal relationship relative to the hub axle 34. The hub support 33 is mounted at a forward distal end of the hub axle 34, while a rear distal end of the hub axle 34 mounts a gear cylinder 35 in a coaxial relationship. A gear rack 36 cooperates with the gear cylinder 35, whereupon reciprocation of the gear rack 36 effects rotation of the gear cylinder 35 and imparts rotation to the hub support 33 to permit projection of a desired flag of the first, second, and third flags through the game board 12. The gear rack 36 includes a boss 37 that projects through a second slot 38 within the game board positioned above the hub axle 34 exteriorly of the path 14. In play of the game, typically as the race car tokens are aligned, the token which crosses the finish line first is declared a winner. Further, positioning of the cars or tokens 18 is effected by qualifying runs with an operator utilizing a time piece to ascertain a time period each token employs to complete a race track path circuit or one complete traverse of the path. In this manner, conventional rules, such as utilized by NASCAR (R) may be employed.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A toy race track apparatus, comprising in combination, a rigid game board, the game board including a top surface, with a continuous race track path recessed within the game board below the top surface, and a plurality of position flags mounted at spaced intervals along an exterior perimeter of the path for indication of path portions in traverse of the path, and a starting line orthogonally directed across the path, and a plurality of race car tokens positioned within the path, and a vibratory housing mounted to the game board, the vibratory housing including a vibratory motor mounted within the vibratory housing, wherein the vibratory housing is of rigid construction to impart vibratory energy into the path, and an on/off switch in electrical communication with the motor, and a rheostat dial in operative association with the motor to control revolutionary speed of the motor, and each token including a token bottom surface, and a plurality of semi-rigid polymeric vibration transfer tabs projecting downwardly relative to the token bottom surface, wherein the tabs include at least one forward tab and at least one rear tab, and a forward turn table cylinder mounted about a forward axle, and a rear turn table cylinder mounted about a rear axle, the forward axle and rear axle are orthogonally oriented relative to the token bottom surface, and the forward tab is mounted to the forward cylinder, and the rear tab is mounted to the rear cylinder, wherein the forward tab and the rear tab define an acute included angle relative to the token bottom surface, and the turn table cylinders are rotatable to effect directional orientation relative to each token, and a first slot directed through the game board, the first slot including a cylindrical hub support positioned below the first slot, the hub support radially mounting a plurality of indicator flags, each indicator flag radially and equally spaced and extending outwardly of the cylindrical hub support and aligned with the first slot to permit selective projection of the indicator flags through the first slot, and the cylindrical hub support including a hub axle, the hub axle including a forward distal end, wherein the forward distal end is coaxially and fixedly mounted to the cylindrical hub support, and the hub axle including a rear distal end, wherein the rear distal end is coaxially and fixedly mounted to a gear cylinder, and a second slot directed through the game board parallel to the first slot, wherein the second slot mounts a gear rack, the gear rack in communication with the gear cylinder, and the gear rack including a gear rack boss projecting through the second slot whereupon reciprocation of the boss within the second slot effects rotation of the gear rack and selective projection of an indicator flag of said first, second, and third indicator flags through the first slot.

* * * * *